US006784406B2

(12) United States Patent
Park

(10) Patent No.: US 6,784,406 B2
(45) Date of Patent: Aug. 31, 2004

(54) MICROWAVE OVEN

(75) Inventor: Jong-Yueol Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 92 days.

(21) Appl. No.: 10/223,473

(22) Filed: Aug. 20, 2002

(65) Prior Publication Data

US 2003/0209543 A1 Nov. 13, 2003

(30) Foreign Application Priority Data

May 13, 2000 (KR) ..... 2002-26240

(51) Int. Cl.[7] ..... H05B 6/66
(52) U.S. Cl. ..... 219/756; 219/761
(58) Field of Search ..... 219/756, 761, 219/741, 746, 7.63, 7.57, 681, 800; 126/21 A; 248/222.52, 222.11

(56) References Cited

U.S. PATENT DOCUMENTS 4,701,586 A * 10/1987 Hagberg ..... 219/746
5,548,105 A * 8/1996 Butterworth et al. ..... 219/761
5,674,425 A * 10/1997 Hong ..... 219/681
5,897,808 A * 4/1999 Kim ..... 219/741
5,986,250 A 11/1999 Kang et al.

* cited by examiner

*Primary Examiner*—Quang T. Van
(74) *Attorney, Agent, or Firm*—Staas & Halsey, LLP

(57) ABSTRACT

A microwave oven having an improved configuration of its mounting bracket to couple a magnetron to a waveguide, to reduce the number of operations to couple the magnetron to a waveguide, and which is stable in a fixed state of the mounting bracket to obtain a more efficient cooling effect for the magnetron. The microwave oven includes an oven body, an inner case disposed in the oven body, which defines a cooking chamber therein and an electric component chamber at its outside, a mounting bracket attached to the electric component chamber, which is provided with one or more pockets and is provided near the pocket with a reinforcing section to prevent bending deformation of the mounting bracket, and a magnetron mounted on the mounting bracket, which has one or more coupling portions to be inserted into the pocket of the mounting bracket.

14 Claims, 6 Drawing Sheets

MICROWAVE OVEN

CROSS-REFERENCE TO RELATED APPLICATIONS

This application claims the benefit of Korean Application No. 2002-26240, filed May 13, 2002, in the Korean Industrial Property Office, the disclosure of which is incorporated herein by reference.

BACKGROUND OF THE INVENTION

1. Field of the Invention

The present invention relates to a microwave oven, and more particularly, to a microwave oven which has an improved configuration of its mounting bracket to couple a magnetron, generating high-frequency electromagnetic waves, to a waveguide, in order to reduce the number of operations to couple the magnetron to the waveguide, and which is adapted to be stable in a fixed state of the mounting bracket to obtain a more efficient cooling effect for the magnetron.

2. Description of the Prior Art

In general, a microwave oven is a cooking appliance which is intended to cook foods in a cooking chamber by intermolecular frictional heating of the foods, which is generated by repeatedly agitating the water molecules of the foods with high-frequency electromagnetic wave energy generated by a magnetron.

As illustrated in FIG. 1, such a conventional microwave oven includes an oven body 1 and a housing 2 adapted to cover both side faces and an upper face of the oven body 1. An internal space of the oven body 1, defined by the housing 2, is divided into two chambers, i.e., a cooking chamber 4 and an electric component compartment 5 by an inner case 3 such that the cooking chamber 4 is located in the inner case 3, and the electric component compartment 5 is disposed adjacent to a side surface of the inner case 3.

The cooking chamber 4 has a cooking tray 4*a* provided at its bottom surface, on which foods to be cooked are placed. The electric component compartment 5 has a magnetron 6 provided therein to generate high-frequency electromagnetic waves into the cooking chamber 4 receiving the foods, a high voltage transformer 5*a* and a high voltage condenser 5*b*. The electric component compartment 5 has a cooling fan 5C provided therein to prevent overheating of the magnetron 6, the high voltage transformer 5*a* and the like, and a waveguide 7 to guide high-frequency electromagnetic waves generated by the magnetron 6 into the cooking chamber 4. The waveguide 7 is mounted on a side wall of the inner case 3. Accordingly, the magnetron 6 is located in the electric component compartment 5 and is coupled to the waveguide 7 to generate and guide high-frequency electromagnetic waves into the cooking chamber 4. The waveguide 7 includes a mounting bracket 8 to fix the magnetron 6 thereto.

FIG. 2 specifically illustrates the mounting bracket 8 and the magnetron 6. As illustrated in the drawing, the mounting bracket 8 is typically made of a thin plate, and is centrally formed with a reception hole 8*a* into which an antenna 6*c* (described hereinafter) of the magnetron 6 is inserted. The mounting bracket 8 is provided around the reception hole 8*a* with a welding portion 8*b* at which the mounting bracket 8 is welded to the waveguide 7 coupled to the inner case 3. By welding the mounting bracket 8 to an inlet portion of the waveguide 7 at the rear face of its welding portion 8*b*, the mounting bracket 8 can be securely fixed to the waveguide 7. The welding portion 8*b* includes upper and lower extensions 8*c* and 8*d*, which extend upwardly and downwardly by certain lengths. The upper and lower extensions 8*c* and 8*d* are formed with two pairs of threaded holes 8*e*, with each of the extensions 8*c* and 8*d* having a pair of threaded holes 8*e*.

The magnetron 6, which is fixed to the mounting bracket 8, comprises a main body 6*a*, and a coupling surface 6*b* defining the face of the main body 6*a* and to be in contact with the mounting bracket 8. The coupling surface 6*b* is centrally provided with the antenna 6*c*, which is inserted into the reception hole 8*a* of the mounting bracket 8 to emit high-frequency electromagnetic waves generated by the main body 6*a* of the magnetron 6 into the waveguide 7. The coupling surface 8*b* is provided at its upper and lower ends with two pairs of coupling extensions 6*d* and 6*e*, each end of the coupling surface 6*b* having a pair of coupling extensions 6*d* or 6*e*. The upper and lower coupling extensions 6*d* and 6*e* are formed with coupling holes 6*f*, which respectively correspond to the threaded holes 8*e* of the mourning bracket 8. Accordingly, the magnetron 6 is securely fastened to the mounting bracket 8 in such a way that after the magnetron 6 is positioned on the mounting bracket 8, such that the coupling holes 6*f* of the magnetron 6 are aligned with the threaded holes 8*e* of the mounting bracket 8, respectively, screws 9 are engaged with the threaded holes 8*f* via the coupling holes 6*f*. However, such a mounting bracket 8 has disadvantages as described hereinafter.

The mounting bracket 8 is adapted to securely support in such a way that four screws inserted into the coupling holes 6*f* of the magnetron 6 are tightened into the threaded holes 8*e* formed at the upper and lower extensions 8*c* and 8*d*. Since this coupling operation requires the four threaded holes 8*e* to be tightened with screws 9, respectively, it is difficult to improve productivity due to the increased number of coupling steps. In addition, four of the screws 9 must be tightened one by one in a predetermined order. To tighten the screws 9 into the threaded holes 8*e*, the position of the magnetron 6 must be precisely adjusted such that the coupling holes 6*f* of the magnetron 6 are aligned with the threaded holes 8*e* of the mounting bracket 8. To precisely position the magnetron 6 is considerably time-consuming, thereby causing difficulty in the assembling operation of the magnetron 6.

Furthermore, since the magnetron 6, which is coupled to the mounting bracket 8, exerts downward load due to its relatively heavy weight, the upper end of the magnetron 6 may be inclined away from the mounting bracket 8 and the welding portion 8*b* adjacent to the upper extension 8*c* may become separated from the waveguide 7. In addition, the lower end of the mounting bracket 8, which is extended downwardly, is apt to bend toward the waveguide 7.

As seen in FIG. 1, the cooling fan 5*c* serves to cool the magnetron 6, the high voltage transformer 5*a* and the like, by sending air introduced from the outside to the electric components. Since the coupling surface 6*b* of the magnetron 6 is hidden by the mounting bracket 8, the coupling surface 6*b* of the magnetron 6 is insufficiently cooled when compared to other portions of the magnetron 6. Hence, it is impossible to sufficiently cool the magnetron 6 due to the configuration of the mounting bracket 8.

SUMMARY OF THE INVENTION

Accordingly, it is an object of the present invention to provide a microwave oven with an improved mounting bracket, coupling a magnetron generating high-frequency electromagnetic waves to a waveguide, in order to reduce the number of operations required to couple the magnetron to a waveguide, and which is adapted to be stable in a fixed state of the mounting bracket to obtain a more efficient cooling effect for the magnetron.

Additional objects and advantages of the invention will be set forth in part in the description which follows and, in part, will be obvious from the description, or may be learned by practice of the invention.

The foregoing and other objects of the present invention are achieved by providing a microwave oven comprising: an oven body; an inner case disposed in the oven body, which defines a cooking chamber therein and an electric component chamber at its outside; a mounting bracket attached to the electric component chamber, which is provided with one or more pockets and is provided near the pocket with a reinforcing section to prevent bending deformation of the mounting bracket, and a magnetron mounted on the mounting bracket, which has one or more coupling portions to be inserted into the pocket of the mounting bracket.

The pocket may be formed by providing a slit on the mounting bracket and bulging a side portion of the slit in a direction to form an inlet at the slit, and the reinforcing section may be formed by depressing a portion of the mounting bracket in the other direction.

The reinforcing section may be positioned to surround the upper portion and both sides of the pocket.

The number of the pockets may be two, and the reinforcing section may comprise an upper-reinforcing portion positioned above the pockets, a center-reinforcing portion positioned between the pockets, and side-reinforcing portions positioned at both outer sides of the pockets, which are integrally formed.

The mounting bracket may be provided with a through-hole to allow a coupling surface of the magnetron attached to the mounting bracket to be exposed to the inside of the electric component compartment.

The mounting bracket may comprise a hanging portion at its upper end, which extends along the upper surface of the inner case.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE INVENTION

Figure 1:
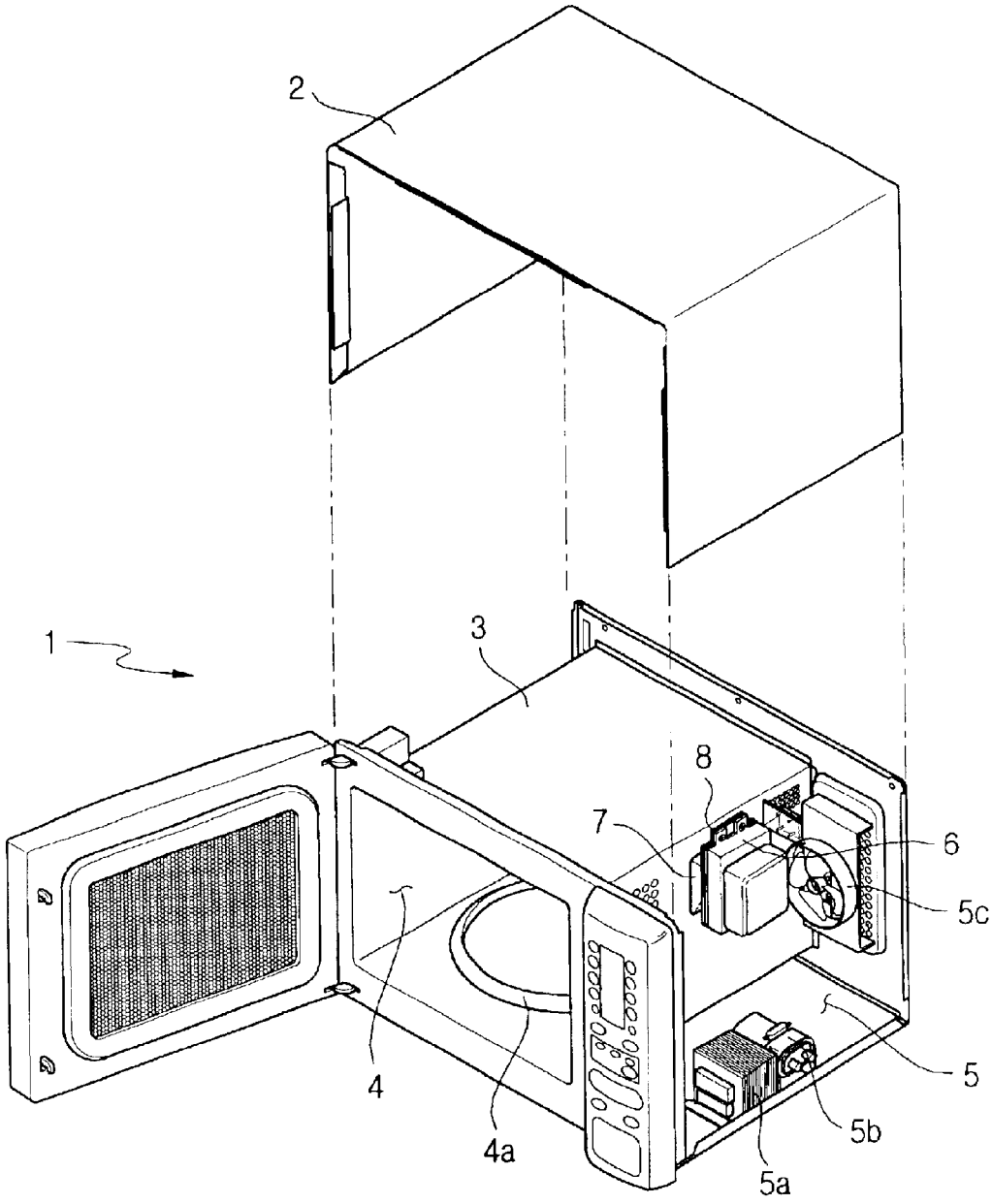
FIG. 1 (Prior Art)
FIG. 1 is a perspective view of a conventional microwave oven, in which the housing is moved to specifically show the internal configuration.
Figure 2:
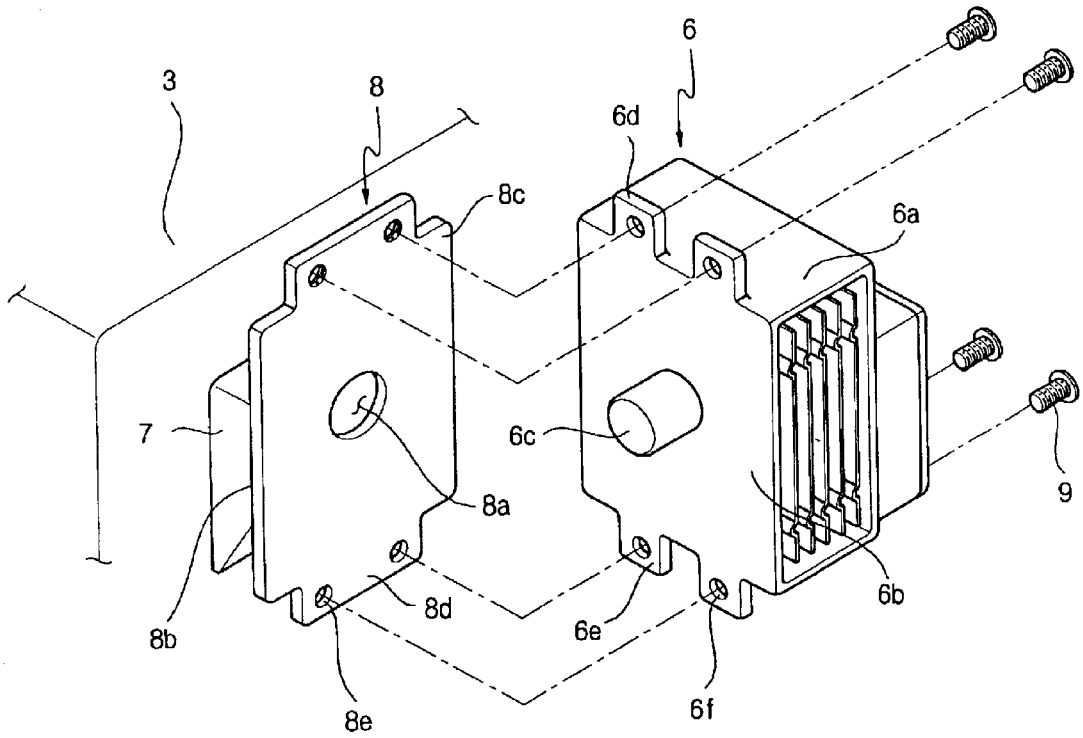
FIG. 2 (Prior Art)
FIG. 2 is an exploded perspective view of a mounting bracket and a magnetron used in a conventional microwave oven.

Reference will now be made in detail to the embodiments of the present invention, examples of which are illustrated in the accompanying drawings, wherein like reference numerals refer to like elements throughout. The embodiments are described below in order to explain the present invention by referring to the figures.

This invention will be described in further detail by way of example with reference to the accompanying drawings.

Figure 3:
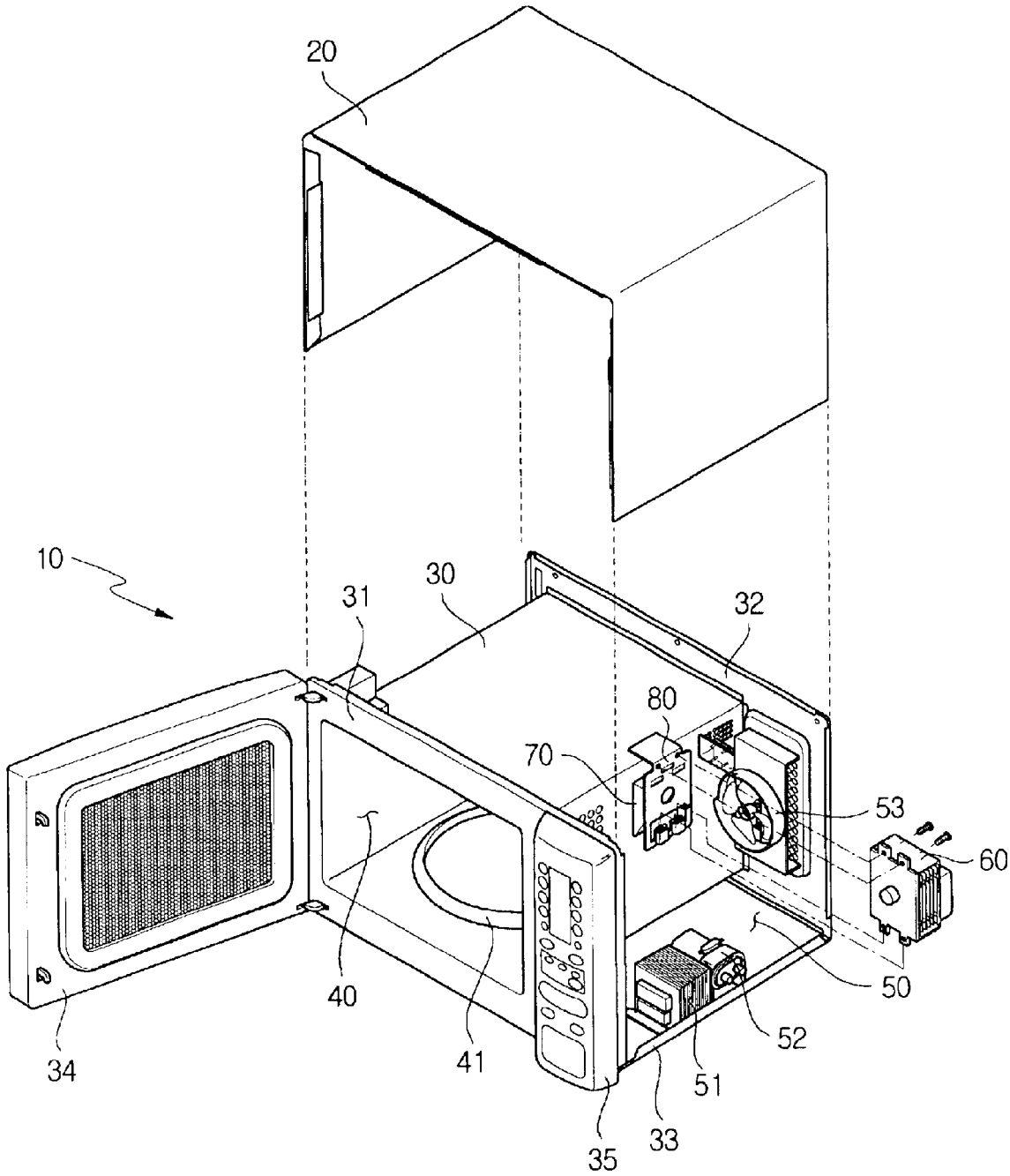
FIG. 3 is a perspective view of a microwave oven according to an embodiment of the present invention, in which a housing is removed to specifically show the internal configuration.

As illustrated in FIG. 3, a microwave oven according to the present invention includes an oven body comprising a hexahedral inner case 30 by which a cooking chamber 40 is defined therein, front and rear panels 31 and 32 attached to front and rear faces of the inner case 30 and a base panel 33 attached to a bottom face of the inner case 30. The oven body 10 is provided with a housing 20 adapted to cover both of its side faces and its upper face. The inner case 30 is installed in the oven body 10 to be positioned at one side of the oven body 10. The inner space defined by the housing 20 is divided into a cooking chamber 40 defined by the inner case 30, and an electric component compartment 50, positioned at one side of the inner case and defined between the housing 20 and the inner case 30.

The inner case 30 is opened at its front face to allow foods to be received in the cooking chamber 40. A door 34 is hingedly connected to the front panel 31 so that the opened front face of the inner case 30 is covered by the door 34. The front panel 31 is provided with a control box 35 having a plurality of control buttons at a side of the door 34 such that the control box 35 covers the front face of the electric component compartment 50.

The cooking chamber 40 defined by the inner case 30 has a rotating tray 41 provided therein on which foods are to be cooked, and which is rotated by a motor (not shown). The electric component compartment 50 has various electric components provided therein to emit high-frequency electromagnetic waves into the cooking chamber 40. The electric components include a magnetron 60 to generate high-frequency electromagnetic waves into the cooking chanter 40, a high voltage transformer 51 to apply high voltage to the magnetron 60, and a high voltage condenser 52.

The electric component compartment 50 also has a cooling fan 53 provided therein to prevent overheating of the magnetron 60 and the high voltage transformer 51, and a waveguide 70 to guide high-frequency electromagnetic waves into the cooking chamber 40. The waveguide 70 is installed on a side wall of the inner case 30. The magnetron 60, disposed in the electric component compartment 50, is coupled to the waveguide 70 to emit high-frequency electromagnetic waves into the cooking chamber 40. To this end, a mounting bracket 80 is attached to the waveguide 70 by a welding operation, to which the magnetron 60 is coupled.

Figure 4:
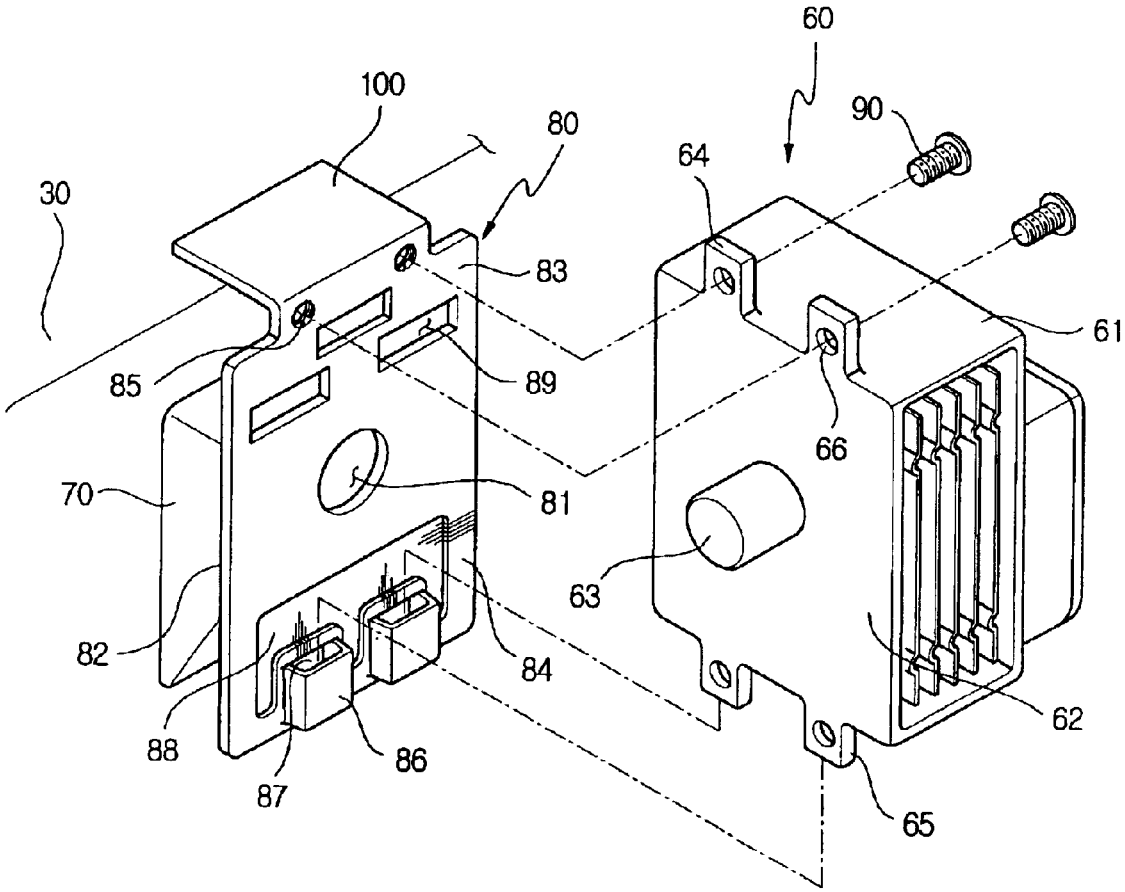
FIG. 4 is an exploded perspective view of the mounting bracket and magnetron used in a microwave oven according to the present invention of FIG. 3.
Figure 5:
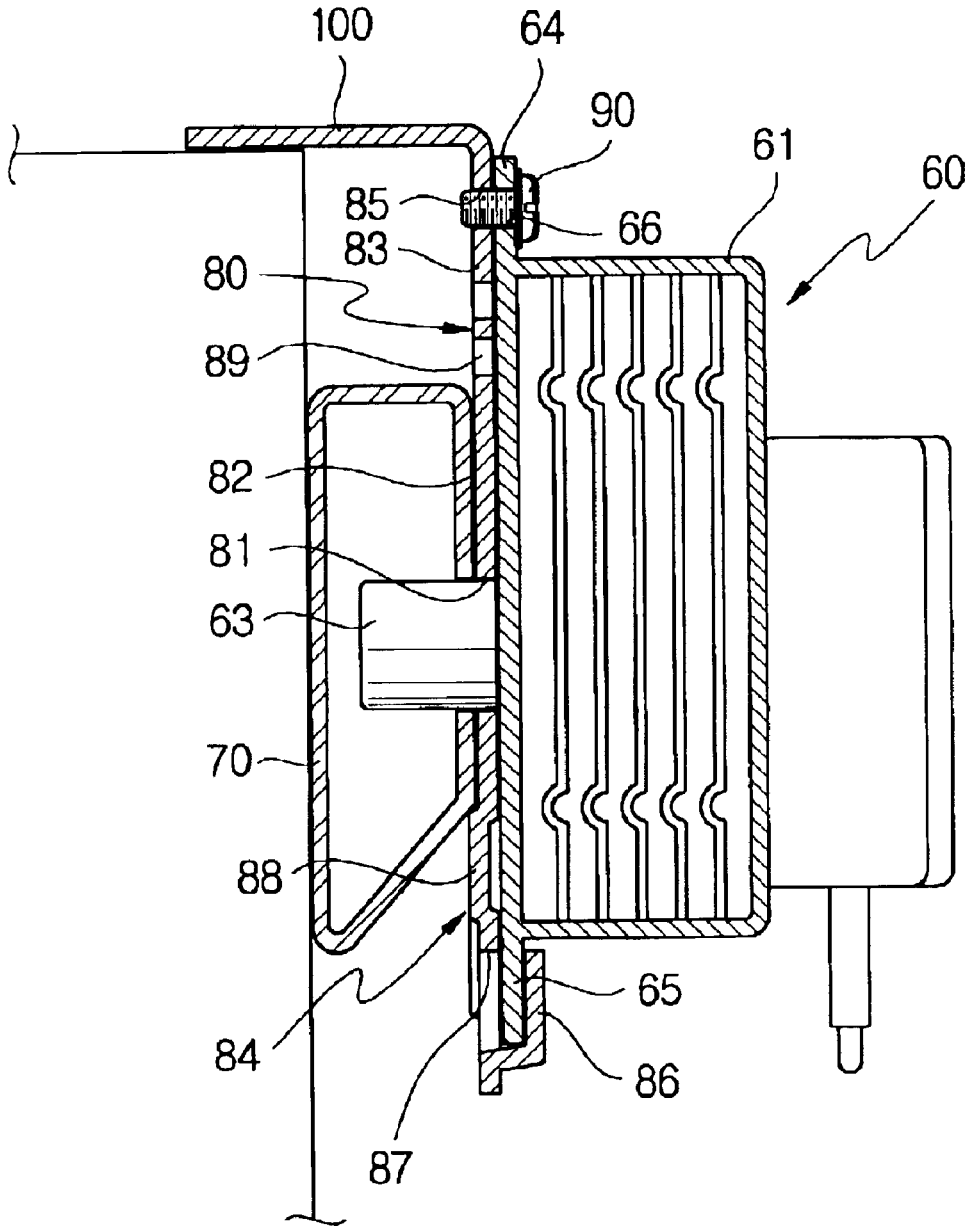
FIG. 5 is a cross-sectional view illustrating a coupled state of the mounting bracket and the magnetron of the microwave oven according to the present invention of FIG. 3.

Referring to FIGS. 4 and 5, there are illustrated configurations of the mounting bracket 80 and the magnetron 60 according to the present invention. As illustrated in FIG. 4, the magnetron 60 includes a main body 61 to generate high-frequency electromagnetic waves. The main body 61 of the magnetron 60 has a coupling surface 62, which is to be in contact with the mounting bracket 80. The coupling surface 62 is centrally provided with an antenna 63 to emit high-frequency electromagnetic waves generated by the main body 60 of the magnetron 60, into the waveguide 70. The coupling surface 62 is provided at its upper and lower ends with a pair of upper coupling extensions 64 and a pair of lower coupling extensions 65, which extend upwardly and downwardly. The two pairs of upper and lower coupling extensions 64 and 65 are formed with coupling holes 66, respectively.

The mounting bracket 80 is made of a thin plate to support the magnetron 60, and is centrally formed with a reception hole 81 through which the antenna 63 of the magnetron 60 is projected into the waveguide 70. The mounting bracket 80 includes a welding portion 82 adjacent to the reception hole 81, which is welded to the waveguide 70. By welding the back side of the welding portion 82 to an inlet of the waveguide 70, the mounting bracket 80 is securely attached to the waveguide 70. The welding portion 82 is provided at its upper and lower ends with an upper extension 83 and a lower extension 84, which extend by a certain length. The upper extension 83 is formed at its upper end with a pair of threaded holes 85 corresponding to the coupling holes 66 of the upper coupling extension 64 of the magnetron 60, and is provided at its lower end with a pair of pockets 86 into which the lower coupling extensions 65 of the magnetron 60 are fitted.

The pockets 86 are formed in such a way that slits 87 of predetermined lengths are formed at the lower end of the lower extension 84 in the direction perpendicular to a longitudinal direction of the mounting bracket 80, and portions of the lower extensions 84 under the slits 87 are bulged forward to form inlets at the slits. The lower coupling extensions 65 of the magnetron 60 are inserted into the pockets 86 through the opened slit 87, and thus cannot be separated from the mounting bracket 80. At this point, it is preferable that the pockets 86 are positioned such that the threaded holes 85 of the mounting bracket 80 are aligned with the coupling holes 64 of the magnetron 60, when the lower coupling extensions 65 of the magnetron 60 are inserted into the pockets 86.

Accordingly, after the lower coupling extensions 65 of the magnetron 60 are inserted into the pockets 86 of the lower extension 84 of the mounting bracket 80, screws 90 are tightened into the threaded holes 85 of the mounting bracket 80 through the coupling holes 66 of the upper coupling extensions 64 of the magnetron 60, thereby enabling the magnetron 60 to be firmly coupled to the mounting bracket 80.

Since the mounting bracket 80, equipped with the pockets 86 according to an embodiment of the present invention, is designed to reduce the number of fastening positions necessary for the coupling of the mounting bracket 80 and the magnetron 60, to the number of two, the number of assembling procedure operations can be reduced. In the configuration, the threaded holes 85 of the mounting bracket 80 can be automatically aligned with the coupling holes 66 of the upper coupling extensions 64 of the magnetron 60 by a simple operation of inserting the lower coupling extensions 65 of the magnetron 60 into the pockets 86 of the mounting bracket 80 and then pushing the magnetron 60 toward the mounting bracket 80. Therefore, there is no cumbersome procedure of positioning the magnetron 60 with respect to the mounting bracket 80 to align the coupling holes 66 of the upper coupling extensions 64 with the threaded holes 85 of the mounting bracket 80. Accordingly, a facilitated coupling operation of the magnetron and the mounting bracket and a reduced number of assembling operations result in improved productivity of the whole microwave oven.

Because the lower extension 84 of the mounting bracket 80 extends outwardly from the inlet of the waveguide 70, there is a problem in that the mounting bracket 80 is bent toward the waveguide 7 due to weight of the magnetron 6. Hence, the mounting bracket 80 is provided, at a region adjacent to the pockets 86, with a reinforcing section 88 to enhance the reinforcing ability of the lower extension 84 of the mounting bracket 80.

Figure 6:
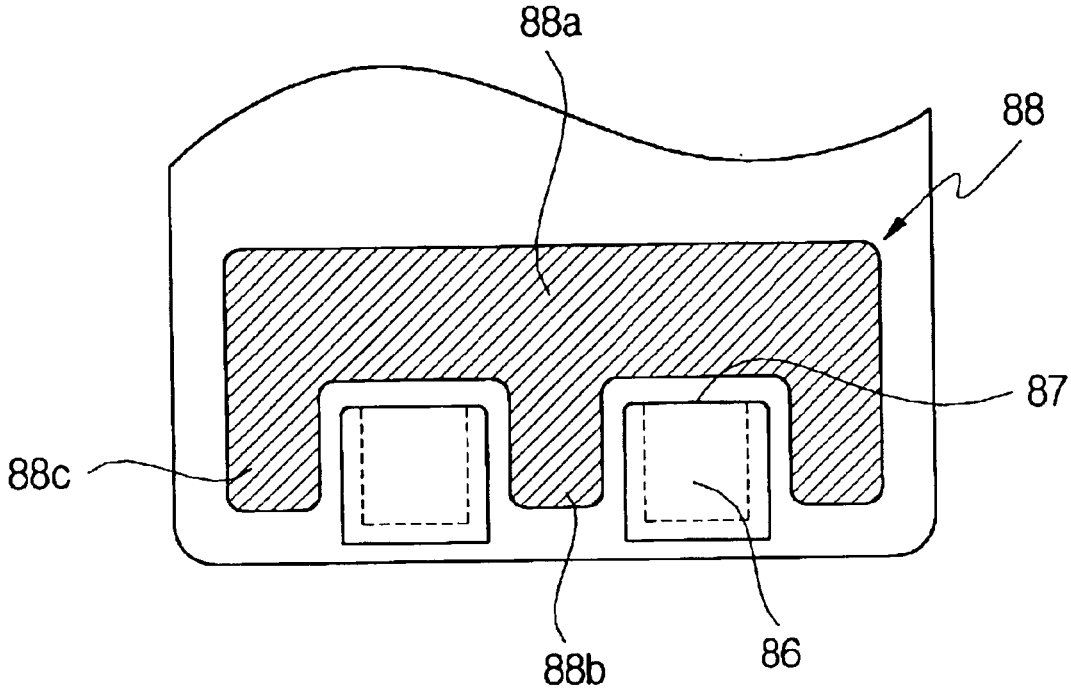
FIG. 6 is a front view of an essential part of the mounting bracket of the microwave oven according to the present invention of FIG. 3.

The reinforcing section 88 is formed by causing the region above and adjacent to the pockets 86 to be depressed toward the rear, by a certain depth, into a bead shape. As best seen in FIG. 6, the reinforcing section 88 comprises an upper-reinforcing portion 88*a* positioned above the pockets 86, a center-reinforcing portion 88*b* positioned between the pair of pockets 86, and side-reinforcing portions 88*c* positioned at both outer sides of the pockets 86, which are integrally formed. Accordingly, since the reinforcing section 88, shaped to surround all sides other than bottom sides of the pockets 86, enhances rigidity of the mounting bracket 80 near the lower extension 84, it is possible to prevent the lower extension 84 of the mounting bracket 80 from being bent toward the waveguide 70 due to force being exerted on its lower end by the weight of the magnetron 60. In this embodiment, since the slits 87 are formed to perforate the mounting bracket 80, portions of the mounting bracket 80 near the slits 87 are inferior to other portions in rigidity. Nevertheless, the portions of the mounting bracket 80 near the slits 87 are reinforced by the reinforcing section 88. Accordingly, it is preferable that the center-reinforcing portion 88*b* and the side-reinforcing portions 88*c* are extended from the upper-reinforcing portion 88*a* to the sides of the pockets 86 such that the lower ends of the center-reinforcing portion 88*b* and the side-reinforcing portions 88*c* are positioned at levels slightly lower than the slits 87.

As previously described, since the microwave oven according to the present invention is designed to reduce the number of fastening positions necessary for the coupling of the mounting bracket 80 and the magnetron 60 to the number of two, by provision of the pockets 86 at the lower end of the mounting bracket 80, the number of procedure operations required to couple the magnetron 60 can be reduced, and the tightening operation of the screws 90 can be easily carried out. Furthermore, the reinforcing section 88 provided near the pockets 86 serves to prevent the lower extension 84 from being bent toward the waveguide 70, and to enhance rigidity of the mounting bracket 80 near the slits 87.

The upper extension 83 of the mounting bracket 80 below the threaded holes 85 is provided with a plurality of through-holes 89. The through-holes 89 serve to allow the coupling surface 62 of the magnetron 60, hidden by the mounting bracket 80, to communicate with the electric component compartment 50. Accordingly, air introduced into the electric component compartment 50 by the cooling fan 53, comes into contact with the coupling surface 62 of the magnetron 60 through the through-holes 89, thereby providing an efficient cooling effect for the magnetron 60.

Since the relatively heavy weight of the magnetron 60 attached to the mounting bracket 80 is exerted downwardly, the upper end of the mounting bracket 80, made of a thin plate, may be inclined toward the magnetron 60. In this case, as the upper end of the mounting bracket 80 is inclined toward the magnetron 60, the upper extension 83, i.e., the welding portion 82 of the mounting bracket 80 may become separated from the waveguide 70. To cope with this problem, the mounting bracket 80 is provided at its upper end with a supporting hanger 100 to provide more stable support for the mounting bracket 80.

The supporting hanger 100 is horizontally extended along the upper surface of the inner case 30 from the upper end of the upper extension 83 of the mounting bracket 80, and is attached thereto. The supporting hanger 100 is attached to the upper surface of the inner case 30 by a welding process or screws. Accordingly, the supporting hanger 100 serves to support the upper end of the mounting bracket 80 in order to prevent the upper end of the mounting bracket 80 from being inclined toward the magnetron 60 due to the weight of the magnetron 60, and to prevent the welding portion 82 from being separated from the waveguide 70.

The through-holes 89, formed at the mounting bracket 80 and the supporting hanger 100, contribute to efficient cooling of the magnetron 60 coupled to the mounting bracket 80, and to provide stable support of the mounting bracket 80, thereby enhancing reliability of a whole microwave oven.

As described above, the present invention provides a microwave oven which is designed to reduce the number of fastening positions necessary to couple the mounting bracket and a magnetron, to the number of two by provision of pockets at the lower end of the mounting bracket, thereby enabling the number of procedure operations required to couple the magnetron and the mounting bracket to be reduced, resulting in improvement of productivity. In addition, a reinforcing section provided near the pockets, which is intended to enhance rigidity of the lower end of the mounting bracket, prevents the lower end of the mounting bracket from being bent toward the waveguide, so that the mounting bracket can more stably support the magnetron. Furthermore, through-holes perforated at the mounting bracket allow the magnetron coupled to the mounting bracket to be efficiently cooled, and the supporting hanger 100 affords stable support of the mounting bracket, leading to an improvement in reliability of a whole microwave oven.

Although an embodiment of the present invention have been shown and described, it would be appreciated by those skilled in the art that changes may be made in this embodiment without departing from the principles and spirit of the invention, the scope of which is defined in the claims and their equivalents.

What is claimed is:

1. A microwave oven, comprising:

an oven body;

an inner case disposed in the oven body defining a cooking chamber therein and an electric component chamber at an outside thereof;

a mounting bracket attached to the electric component chamber comprising one or more pockets and a reinforcing section provided adjacent to the one or more pockets to prevent bending deformation of the mounting bracket; and a magnetron mounted on the mounting bracket comprising one or more coupling extensions to be inserted into the one or more pockets of the mounting bracket.

2. The microwave oven as set forth in claim 1, wherein the one or more pockets are formed, respectively, by providing a slit on the mounting bracket and bulging a side portion of the slit in a direction to form an inlet at the slit, and the reinforcing section is formed by depressing a portion of the mounting bracket in another direction.

3. The microwave oven as set forth in claim 1, wherein the reinforcing section surrounds an upper portion and side portions of the one or more pockets.

4. The microwave oven as set forth in claim 1, wherein the one or more pockets comprises two pockets, and the reinforcing section comprises:

an upper-reinforcing portion positioned above the two pockets;

a center-reinforcing portion positioned between the two pockets; and side-reinforcing portions positioned at outer sides of the two pockets, respectively.

5. The microwave oven set forth in claim 4, wherein the upper-reinforcing portion, the center-reinforcing portion and the side-reinforcing portions are integrally formed.

6. The microwave oven as set forth in claim 1, wherein the mounting bracket comprises a through-hole to allow a coupling surface of the magnetron attached to the mounting bracket to be exposed to an inside of the electric component compartment.

7. The microwave oven set forth in claim 6, wherein the coupling surface comprises an antenna centrally located thereat to emit high-frequency electromagnetic waves generated by the magnetron.

8. The microwave oven set forth in claim 7, further comprising:

a waveguide to guide high-frequency electromagnetic waves into the cooking chamber;

a welding portion provided on the mounting bracket and welded to the waveguide; and a reception hole provided on the mounting bracket and adjacent to the welding portion through which the antenna is projected into the waveguide.

9. The microwave oven set forth in claim 6, wherein the one or more coupling extensions include a pair of upper coupling extensions at an upper end of the coupling surface and a pair of lower coupling extensions at a lower end of the coupling surface.

10. The microwave oven set forth in claim 9, wherein each of the upper coupling extensions and the lower coupling extensions comprises a coupling hole.

11. The microwave oven set forth in claim 10, wherein the mounting bracket comprises an upper extension and a lower extension, said upper extension having a pair of threaded holes corresponding to the coupling holes of the upper coupling extensions of the magnetron such that threaded screws fasten said upper extension to said upper coupling extensions.

12. The microwave oven as set forth in claim 1, wherein the mounting bracket comprises a hanging portion at an upper end thereof, which extends along an upper surface of the inner case.

13. The microwave oven set forth in claim 12, wherein the mounting bracket is formed of a thin plate.

14. A microwave oven having an oven body, comprising:

an inner case disposed in the oven body defining a cooking chamber therein and an electric component chamber at an outside thereof;

a mounting bracket coupled to the electric component chamber and comprising a reinforced portion; and a magnetron coupled to the mounting bracket at one or more coupling portions, wherein the reinforced portion of the mounting bracket is located adjacent to the one or more coupling portions to prevent a deformation of the mounting bracket.

* * * * *

UNITED STATES PATENT AND TRADEMARK OFFICE

CERTIFICATE OF CORRECTION

PATENT NO. : 6,784,406 B2
DATED : August 31, 2004
INVENTOR(S) : Jong-Yueol Park

It is certified that error appears in the above-identified patent and that said Letters Patent is hereby corrected as shown below:

Title page,
Item [30], Foreign Application Priority Data, change "May 13, 2000" to
-- May 13, 2002 --

Signed and Sealed this

Twenty-second Day of February, 2005

JON W. DUDAS
*Director of the United States Patent and Trademark Office*